US007040589B2

(12) United States Patent
Wang

(10) Patent No.: US 7,040,589 B2
(45) Date of Patent: May 9, 2006

(54) ADJUSTABLE GARMENT ROD

(75) Inventor: Chi-Chung Wang, Kaohsiung Hsien (TW)

(73) Assignee: Chi Yu Steel Co., Ltd., Kaohsiung Hsien (TW)

( * ) Notice: Subject to any disclaimer, the term of this patent is extended or adjusted under 35 U.S.C. 154(b) by 99 days.

(21) Appl. No.: 10/791,543

(22) Filed: Mar. 1, 2004

(65) Prior Publication Data

US 2005/0189457 A1 Sep. 1, 2005

(51) Int. Cl.
*A47F 5/00* (2006.01)

(52) U.S. Cl. ..... 248/289.11; 248/292.12; 248/292.14; 248/242

(58) Field of Classification Search ..... 248/289.11, 248/288.11, 274.1, 200, 251, 292.11–14, 248/222.51, 222.52, 240, 241, 242, 246
See application file for complete search history.

(56) References Cited

U.S. PATENT DOCUMENTS 473,919 A * 5/1892 Edsall ..... 248/292.12
5,452,875 A * 9/1995 Kern ..... 248/242
6,354,549 B1 * 3/2002 Sweere et al. ..... 248/292.14

* cited by examiner

*Primary Examiner*—Robert P. Olszewski
*Assistant Examiner*—Todd M. Epps
(74) *Attorney, Agent, or Firm*—Alan D. Kamrath; Nokolai & Mersereau, P.A.

(57) ABSTRACT

An adjustable garment rod includes a mounting bracket, an inner housing, a resilient element and a suspension arm. The mounting bracket has an arm slot and a first toothed ratchet surface and second toothed ratchet surface formed alongside the arm slot. The inner housing is mounted pivotally in the arm slot and holds the suspension arm. The suspension arm extends out of the arm slot and has two toothed protrusions. The resilient element presses the suspension arm so that the toothed protrusions engage the toothed ratchet surfaces to hold firmly the suspension arm at a given angular position. Further, the garment rod uses several simple parts so that assembling the garment rod is easy and quick, which saves costs and time.

11 Claims, 8 Drawing Sheets

ADJUSTABLE GARMENT ROD

BACKGROUND OF THE INVENTION

1. Field of the Invention

The present invention relates to a garment rod and, more particularly, to an adjustable garment rod with a conveniently adjustable angle of suspension.

2. Description of Related Art

With reference to FIG. 7, a conventional adjustable garment rod (6) in accordance with prior art comprises a mounting bracket (60), a pivot seat (74), a suspension arm (70) and multiple restitution springs (75). The mounting bracket (60) attaches the garment rod (6) to a post (69). The pivot seat (74) is mounted pivotally in the mounting bracket (60). The suspension arm (70) is attached to and is held by the pivot seat (74) so that the angular position of the suspension arm (70) can be adjusted.

The mounting bracket (60) comprises a bracket body (61) and a mounting ring (62). The bracket body (61) has transverse slot (610), two upper lips (611) and two lower lips (612) where only one upper lip (611) and one lower lip (612) are shown in the FIG. 7. The transverse slot (610) is defined between the upper and the lower lips (611, 612). The upper lips (611) are formed alongside the transverse slot (610), and each of the upper lips (611) has a curved edge (614) and multiple seat detents (615). The seat detents (615) are defined in the curved edge (614). Likewise, the lower lips (612) are formed alongside the transverse slot (610), and each of them has a curved edge (616) and multiple arm detents (617). The curved edges (616) of the lower lips (612) are opposite to the curved edges (614) of the upper lips (611). The arm detents (617) are defined in the curved edges (616). The mounting ring (62) connects to the bracket body (61) and is attached to the post (69).

The pivot seat (74) is mounted pivotally in the transverse slot (610) by a pivot fastener (63) and has an engaging ball (76) and an arm passage (741). The engaging ball (76) selectively corresponds to the seat detents (615) and is held in one of the seat detents (615) to hold the pivot seat (74) in position. The arm passage (741) holds the suspension arm (70).

The suspension arm (70) has an insert (72), a top edge (701), at least one hanging recess (71) and two positioning studs (73). The insert (72) is inserted into and held in the arm passage (741) and has an elongated hole (721) and an inside end (722). The elongated hole (721) holds slidably the pivot fastener (63). The at least one hanging recess (71) is defined along the top edge (701). The positioning studs (73) protrude alongside the insert (72) and extend, respectively, toward the lower lips (612) of the bracket body (61). The positioning studs (73) correspond, respectively, to the lower lips (612), engage selectively the arm detents (617) in the corresponding lower lip (612) to position the suspension arm (70).

The restitution springs (75) are mounted in the arm passage (741) and provide a restitution force on the inside end (722) of the insert (72) so the positioning studs (73) can be firmly held in the corresponding arm detents (617). Therefore, the suspension arm (70) can be maintained at a given angular position when the positioning studs (73) engage and are held in the arm detents (617).

The suspension arm (70) is adjusted by pushing the suspension arm (70) into the arm passage (741) until the positioning studs (73) disengage from the arm detents (617). The suspension arm (70) can be pivoted about the pivot fastener (63) to change its angular position because the positioning studs (73) are out of the arm detents (617). When the suspension arm (70) is pivoted, the engaging ball (76) will slide out of the current seat detent (615) and slip into the adjacent seat detent (615) and make a clicking sound.

However, operating the conventional garment rod (6) requires that the suspension arm (70) always be pushed into the arm passage (741) before the suspension arm (70) can be adjusted. Since the suspension arm (70) must be pushed against the restitution springs (75) before the angular position of the suspension arm (70) can be changed, the conventional garment rod (6) is inconvenient to use.

Since the positioning studs (73) bear virtually all of the weight hanging on the suspension arm (70), the positioning studs (73) limit the weight of objects that can be hung on the conventional garment rod (6). When the conventional garment rod (6) is made of light material such as plastic, the positioning studs (73) are too weak to bear a heavy weight and may be broken.

The engaging ball (76) in the conventional garment rod (6) engage the seat detents (615) and provides an auxiliary support to increase the weight bearing capability of the suspension arm (70). However, the engaging ball (76) increases the overall complexity of the structure of the garment rod (6) and makes assembly of the garment rod (6) difficult.

With further reference to FIG. 8, another embodiment of a conventional garment rod (8) in accordance with the prior art modifies the insert (72) and the pivot seat (74). The modification is implemented with a stationary pivot body (81), two restitution springs (82), a sliding hole (83) and a spring hole (84). The sliding hole (83) and the spring hole (84) are defined in the inside end (722) of the insert (72). The stationary pivot body (81) is pivotally mounted in the bracket body (61), slidably held in the sliding hole (83) and has a blind hole (811). A restitution spring (82) is mounted and held in the blind hole (811). The engaging ball (76) is partially held in the blind hole (811), compresses the restitution spring (82) in the blind hole (811) and engages one of the seat detents (615). The restitution spring (82) is mounted in the spring hole (84) and has an end abutting the pivot body (81).

The garment rod (8) also needs to be pushed into the bracket body (61) to disengage the positioning studs (73) from the arm detents (617) to adjust the garment rod (8). The operation is inconvenient. Also, the garment rod (8) uses only two restitution springs (82) to provide the restitution force to position the suspension arm (70), which limits the weight the suspension arm (70) can support.

The aforesaid two garment rods (6, 8) can only be adjusted horizontally, but cannot be further adjusted upward to approach a vertical position. Therefore, use of the two conventional rods (6, 8) is restricted.

To overcome the shortcomings, the present invention provides an improved garment rod to mitigate or obviate the aforementioned problems.

SUMMARY OF THE INVENTION

The main objective of the present invention is to provide an improved adjustable garment rod that uses a suspension arm with toothed protrusions and an adjustable ratchet mounting bracket with toothed surfaces to firmly position the suspension arm at a given angular position when the toothed protrusions engage the toothed surfaces.

An objective of the present invention is to provide an adjustable garment rod that is convenient to operate.

The adjustable garment rod in accordance with the present invention includes an adjustable ratchet mounting bracket, an inner housing, a resilient element and a suspension arm. The adjustable ratchet mounting bracket has an arm slot and first and second toothed ratchet surfaces formed alongside the arm slot. The inner housing is rotatably held in the arm slot and holds the suspension arm with the resilient element. The suspension arm extends out of the arm slot and has two toothed protrusions. The resilient element provides a restitution force acting on the suspension arm so that the toothed protrusions engage respectively the toothed ratchet surfaces to hold firmly the suspension arm at a given angular position. Further, the garment rod uses several simple parts so that assembling the garment rod is easy and quick, which saves costs and time.

Other objectives, advantages and novel features of the invention will become more apparent from the following detailed description when taken in conjunction with the accompanying drawings.

DETAILED DESCRIPTION OF PREFERRED EMBODIMENT

Figure 1:
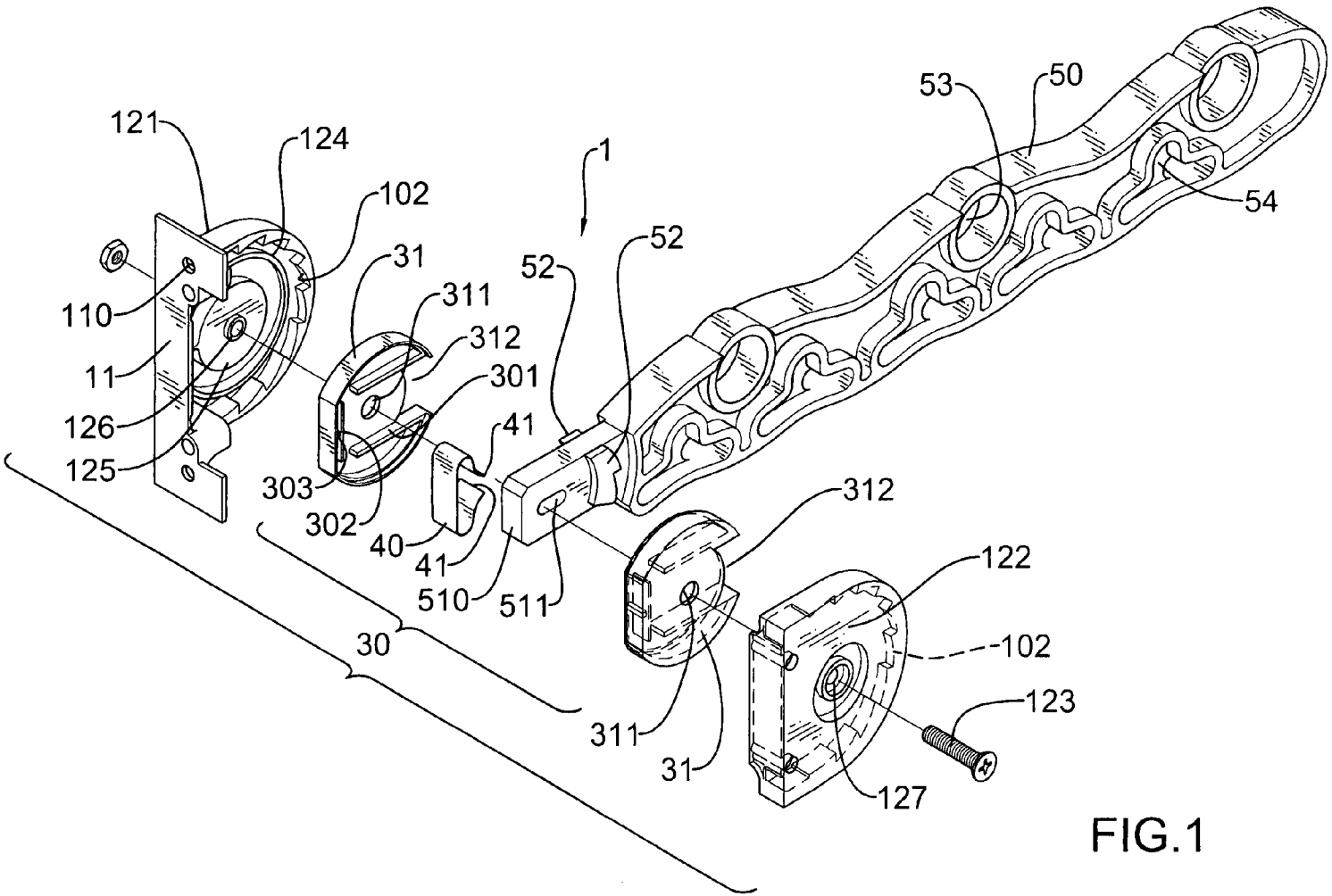
FIG. 1 is an exploded perspective view of an adjustable garment rod in accordance with the present invention.
Figure 6:
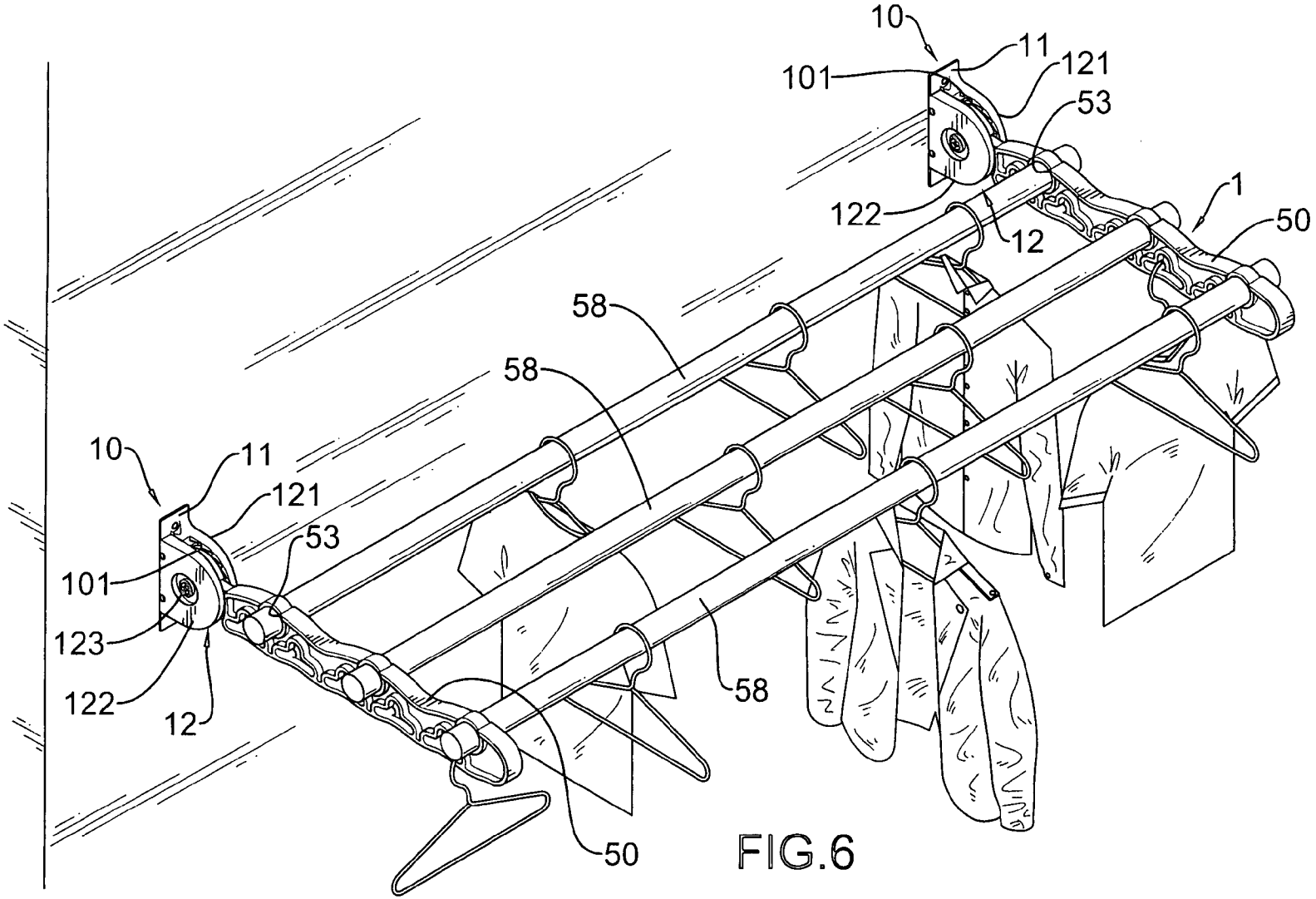
FIG. 6 is an operational perspective view of two garment rods in FIG. 1 with multiple transverse rods to hang clothes.
Figure 7:
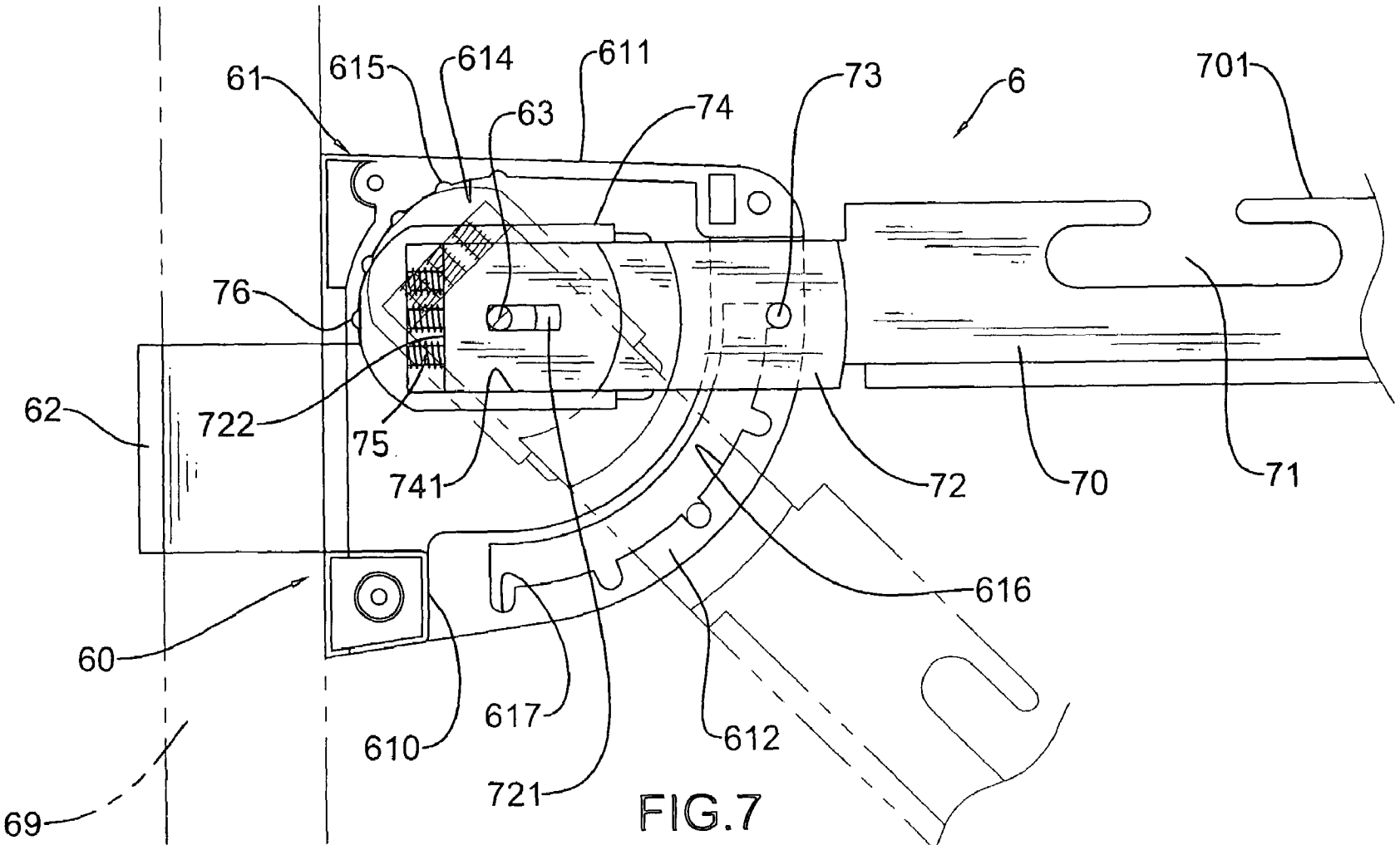
FIG.7 PRIOR ART
FIG. 7 is an operational side plan view in partial section of a segment of a conventional garment rod in accordance with prior art.
Figure 8:
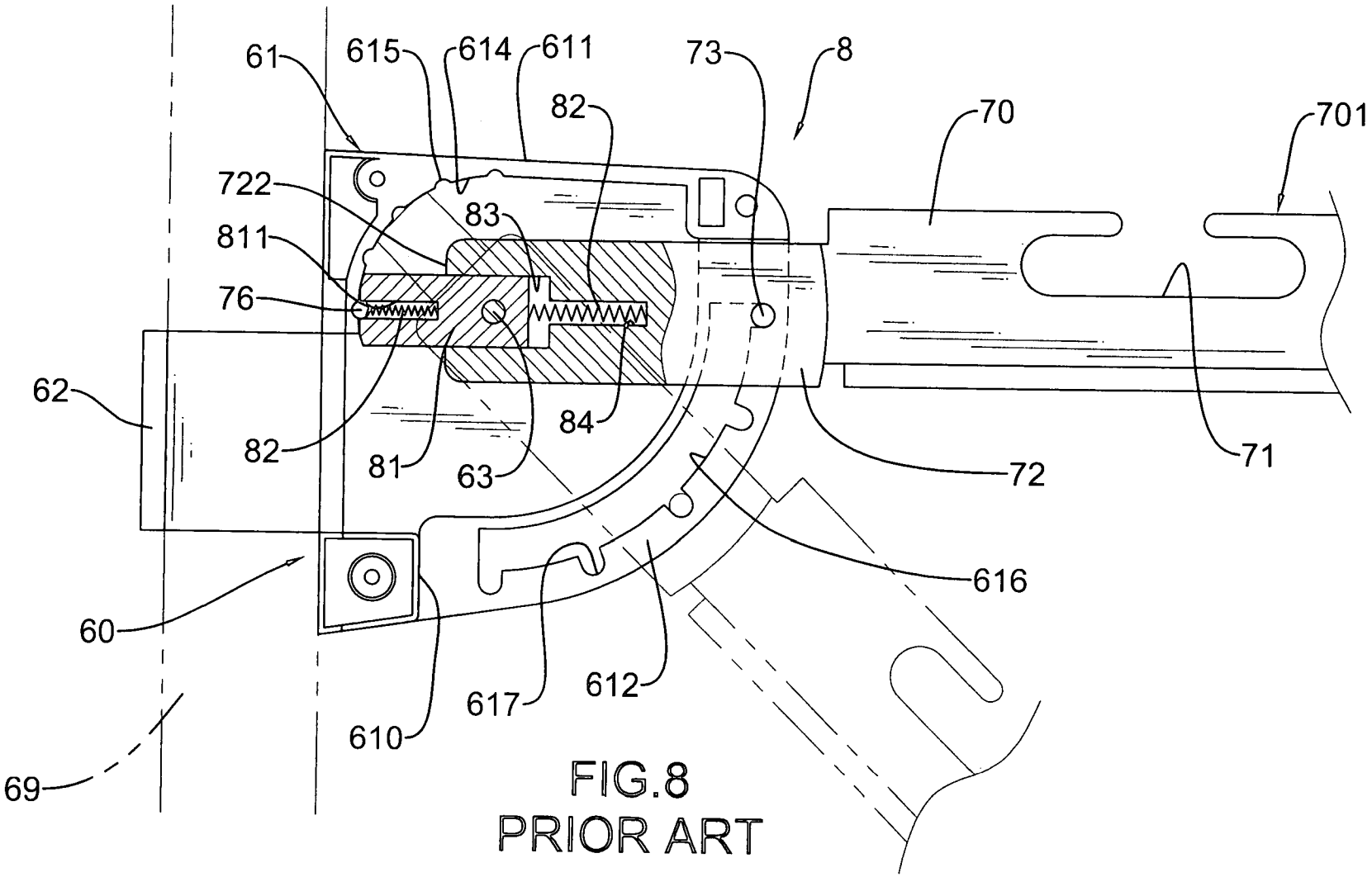
FIG.8 PRIOR ART
FIG. 8 is an operational side plan view in partial section of a segment of another embodiment of a conventional garment rod in accordance with prior art.

With reference to FIGS. 1 and 6, an adjustable garment rod (1) in accordance with the present invention comprises a mounting bracket (10), an inner housing (30), a resilient element (40) and a suspension arm (50).

The mounting bracket (10) is used to mount the garment rod (1) on a wall (not numbered), has an arm slot (101) and a ratchet device (not numbered) and comprises a mounting plate (11) and an outer housing (12). The arm slot (101) is defined vertically completely through the outer housing (12) of the mounting bracket (10). The ratchet device may comprise two toothed ratchet surfaces (102) located alongside the arm slot (101). The mounting plate (11) has two mounting holes (110). The outer housing (12) is mounted on the mounting plate (11) and comprises a stationary half casing (121), a detachable half casing (122) and a fastener (123).

The stationary half casing (121) is integrally formed on the mounting plate (11) and has a toothed ratchet surface (102), an annular rib (124), a protruding disk (125) and a through hole (126). The toothed ratchet surface (102) is essentially circular, has a flat non-toothed segment (not numbered) corresponding to the mounting plate (11) and faces inward. The annular rib (124) is formed inside the toothed ratchet surface (102) and corresponds to the toothed ratchet surface (102). The protruding disk (125) is formed concentrically inside the annular rib (124) and has a center (not numbered). The through hole (126) is defined in the center of the protruding disk (125).

The detachable half casing (122) is attached to the mounting plate (11), aligned with the stationary half casing (121) to define the arm slot (101) and has a toothed surface (102) and a through hole (127). The toothed surface (102) in the detachable half casing (122) corresponds to the toothed surface (102) in the stationary half casing (121). The through hole (127) is defined completely through the detachable half casing (122) and aligns with the through hole (126) in the stationary half casing (121).

Figure 2:
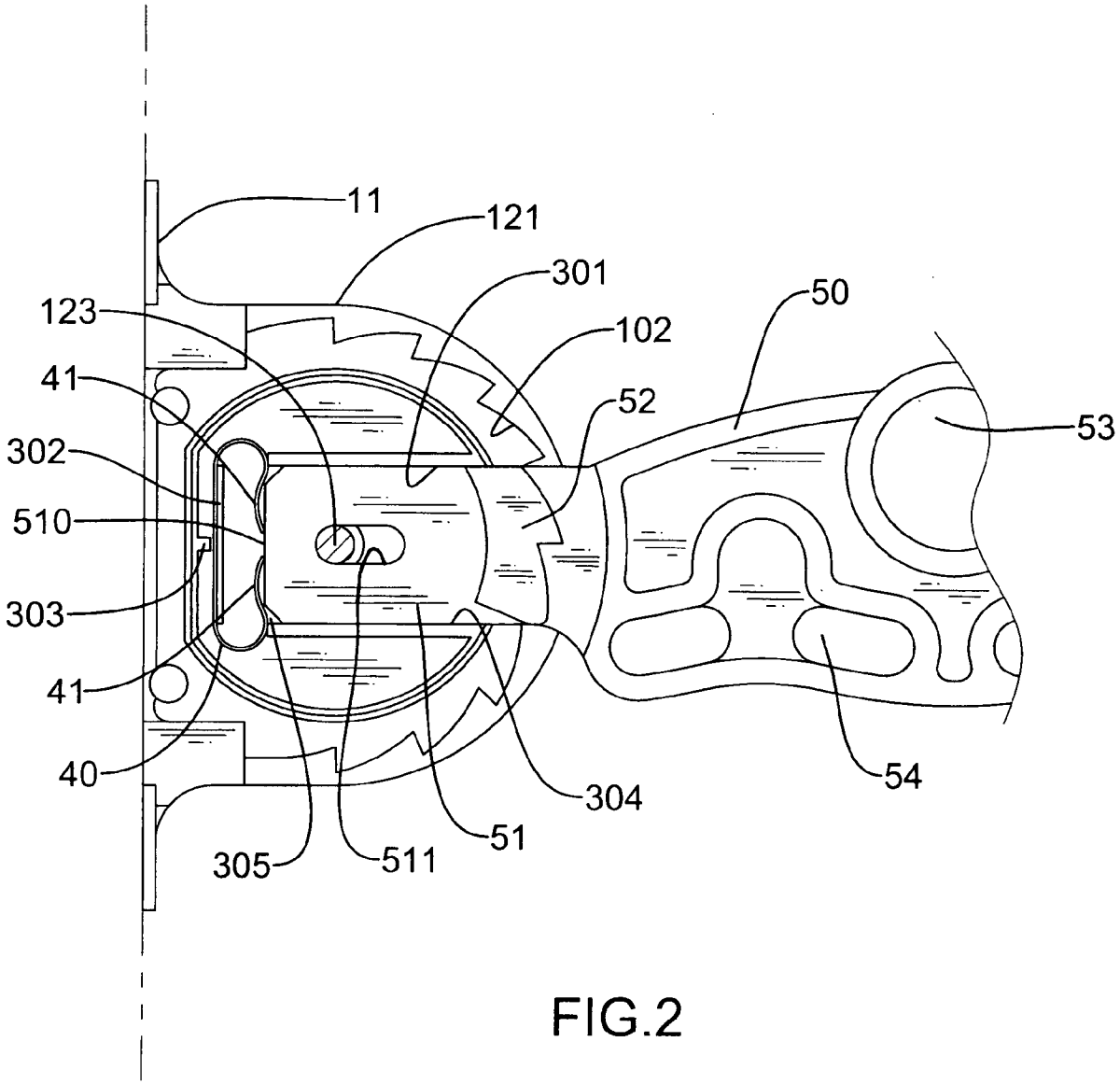
FIG. 2 is an operational side plan view in partial section of a mounting bracket of the garment rod in FIG. 1.

With further reference to FIG. 2, the inner housing (30) is mounted pivotally between the stationary and the detachable half casings (121, 122) in the arm slot (101) in the mounting bracket (10) by the fastener (123), comprises two half casings (31) and has an arm passage (301), a resilient element holder (302) and a positioning nub (303). The half casings (31) have aligned pivot holes (311) and front recesses (312). The arm passage (301) has a front opening (304) and a rear opening (305). The resilient element holder (302) is formed adjacent to the rear opening (305) and is aligned with the arm passage (301). The positioning nub (303) extends toward the resilient element holder (302) and defines a gap (not numbered).

The resilient element (40) may be a resilient looped strip, is inserted and held in the gap between the positioning nub (303) and the resilient element holder (302) and has two free ends (41). The free ends (41) are bent toward each other and positioned adjacent to the rear opening (305).

The suspension arm (50) is mounted in and extends out of the mounting bracket (10) through the arm slot (101), abuts the resilient element (40) and has an insert (51), two toothed protrusions (52), a top edge (not numbered), a bottom edge (not numbered), multiple annular holes (53) and multiple elongated holes (54). The toothed protrusions (52) are formed on the insert (51), correspond, respectively, to the front recesses (312) in the inner housing (30) and engage, respectively, the toothed surfaces (102) in the mounting bracket (10). The insert (51) is inserted into the arm passage (301) through the front opening (304), is held in the arm passage (301) and has an inner end (510) and a sliding hole (511). The inner end (510) abuts and is pressed by the free ends (41) of the resilient element (40) so the toothed protrusions (52), respectively, engage the toothed ratchet surfaces (102) to hold the suspension arm (50) at a given angular position. The sliding hole (511) is defined completely through the insert (51), is aligned with the pivot holes (311) is held in place by the fastener (123) and allows the suspension arm (50) to move longitudinally within the limits of the sliding hole (511).

The fastener (123), such as a bolt, extends into and is held in the through hole (127) of the detachable half casing (122), the pivot holes (311) in the inner housing (30), slidably held in the sliding hole (511) of the insert (51) and is held in and extends out of the through hole (126) in the stationary half casing (121) to screw into a nut (not numbered). This allows the inner housing (30) to pivot relative to the outer housing (12) and the suspension arm (50) to move longitudinally so the toothed protrusions (52) can engage or disengage from the toothed ratchet surfaces (102).

The annular holes (53) and the elongated holes (54) are defined transversely completely through the suspension arm (50), respectively, along the top and bottom edges. All the annular and the elongated holes (53, 54) can be used to hang objects.

However, a pair of garment rods (1) may be attached to a wall parallel to each other, and transverse rods (58) can be mounted in the annular holes (53) between the garment rods (1).

Figure 3:
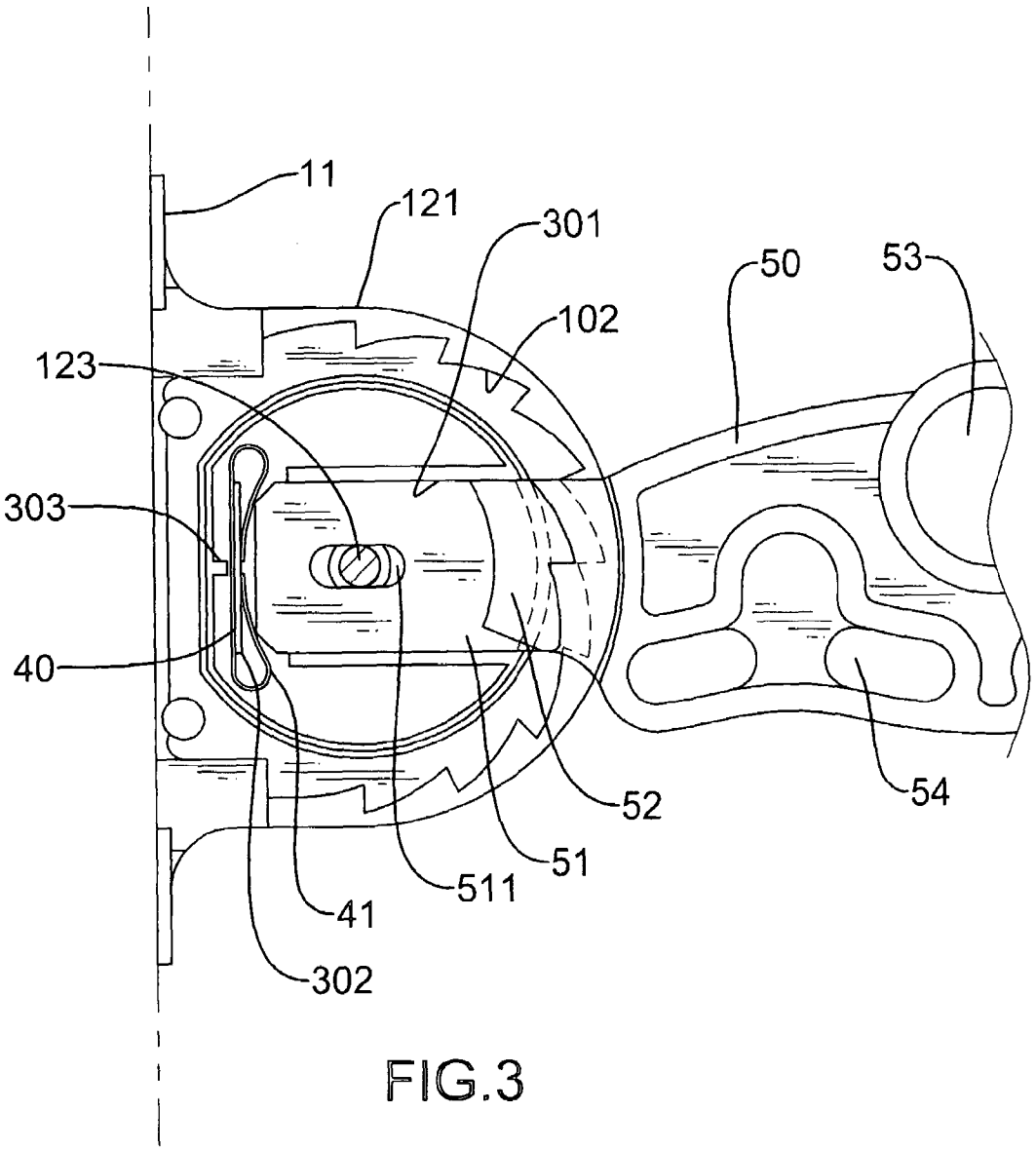
FIG. 3 is an operational side plan view in partial section of the mounting bracket in FIG. 2 with the suspension arm pushed into the mounting bracket.

With reference to FIGS. 1, 3 and 6, the suspension arm (50) is adjusted in a downward direction by pushing the suspension arm (50) into the outer housing (12). The insert (51) slides along the arm passage (301), and the inner end (510) compresses the free ends (41) of the resilient element (40). As the insert (52) slides along the arm passage (301), the toothed protrusions (51) disengage from the toothed ratchet surfaces (102) and slide, respectively, into the front recesses (312) of the half casings (31).

Figure 4:
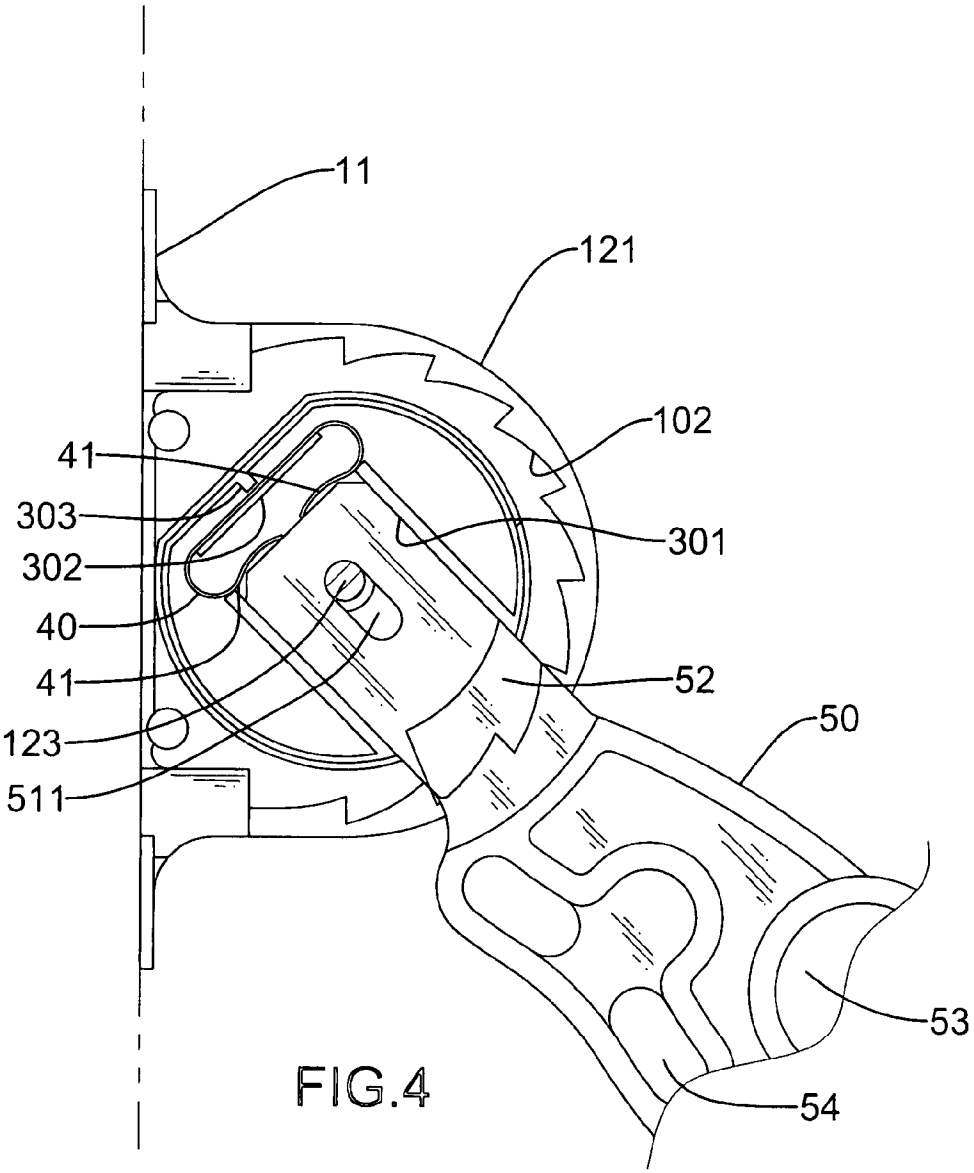
FIG. 4 is an operational side plan view in partial section of the mounting bracket in FIG. 2 when the suspension arm has been adjusted.

With reference to FIG. 4, the suspension arm (50) is pivoted around the fastener (123) to a desired annular position while the toothed protrusions (52) are disengaged from the toothed ratchet surfaces (102). When the suspension arm (50) is in the desired position, the suspension arm (50) is released, and the resilient element (40) pushes the insert (51) until the toothed protrusions (52) engage the toothed ratchet surfaces (102). When the toothed protrusions (52) engage the toothed ratchet surfaces (102), the suspension arm (50) is held securely in place.

Figure 5:
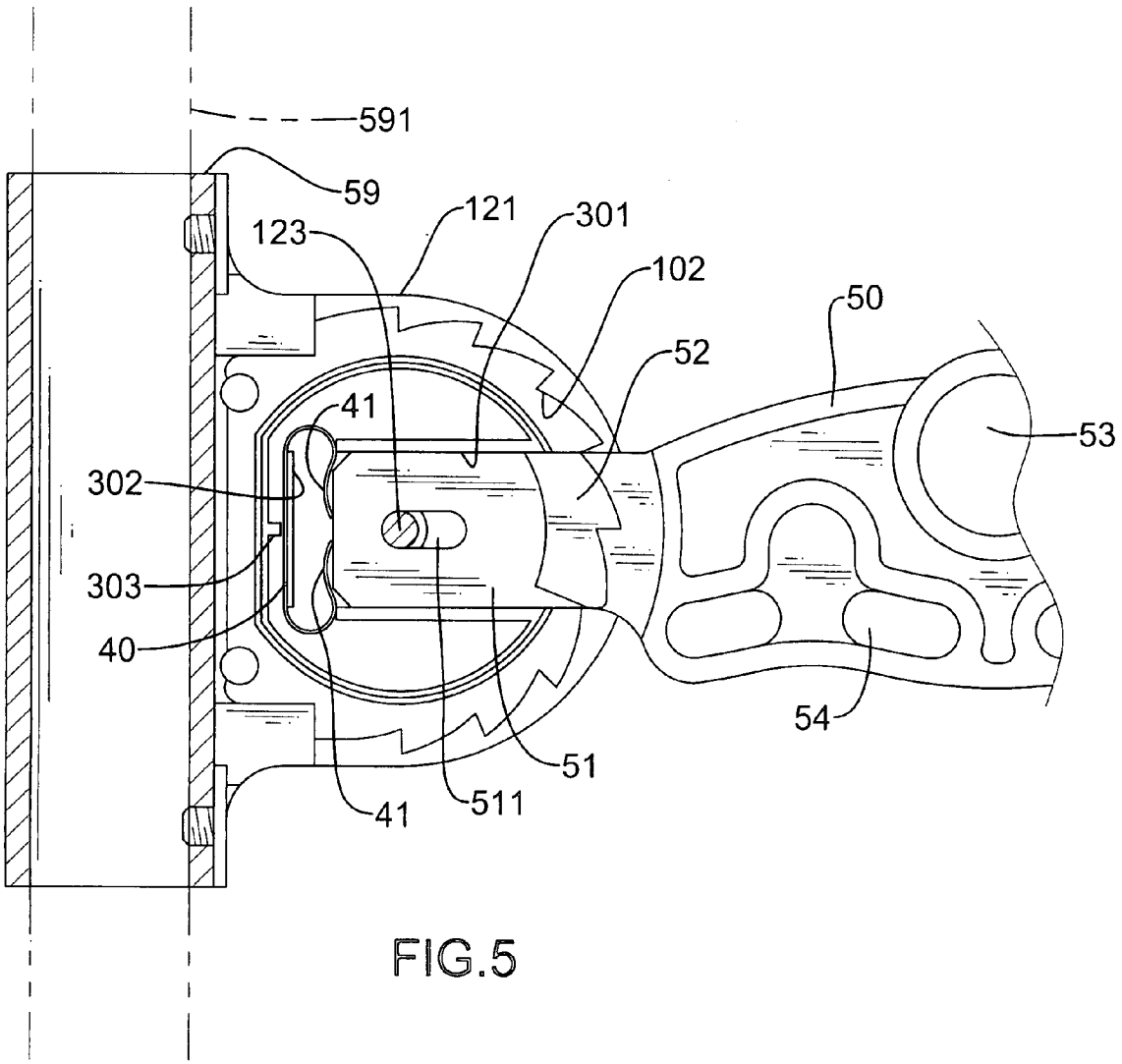
FIG. 5 is an operational side plan view in partial section of an alternative embodiment of the mounting bracket of the garment rod in FIG. 1 with the garment rod mounted on a post.

With reference to FIGS. 1 and 5, a second embodiment of the garment rod (1) in accordance with the present invention replaces the mounting plate (11) of the aforesaid garment rod (1) with a post sleeve (59) so the garment rod (1) can be mounted on a post (591). The post sleeve (59) is slidably mounted on the post (591). The bracket body (12) including the stationary and the detachable half casings (121, 122) are attached to the post sleeve (59).

The adjustable garment rod (1) in accordance with the present invention has the following advantages over the prior art. The suspension arm (50) can be adjusted in a range of 180° from vertical up to vertical down. The bent free ends (41) of the resilient element (40) provide a larger contacting area abutting the inner end (510) of the insert (51) than a conventional spring. The restitution force of the resilient element (40) will push the toothed protrusions (52) to firmly engage the toothed ratchet surfaces (102), which will efficiently hold the suspension arm (50) in place.

Moreover, the toothed ratchet surfaces (102) permit the suspension arm (50) to be pivoted upward without pushing the suspension arm (50), which makes the present invention convenient to use.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the scope of the appended claims.

What is claimed is:

1. An adjustable ratchet garment rod comprising:

a mounting bracket having an arm slot defined completely through the mounting bracket in a vertical direction and a first toothed ratchet surface and a second toothed ratchet surface formed alongside the arm slot;

an inner housing mounted pivotally in the arm slot and having an arm passage with a front opening and a rear opening, and a resilient element holder formed adjacent to the rear opening in the arm passage;

a resilient element mounted on the resilient element holder and having two free ends bent toward the rear opening of the arm passage; and a suspension arm mounted in the inner housing and having an insert slidably extending into and retractably held in the arm passage through the front opening and two toothed protrusions formed transversely on the insert to engage respectively the toothed ratchet surfaces to hold the suspension arm at a specific angular position, and the insert having an inner end abutting the free ends of the resilient element, wherein the mounting bracket comprises a mounting plate with multiple mounting holes; and an outer housing mounted on the mounting plate and comprising a stationary half casing integrally formed on the mounting plate and having the first toothed ratchet surface and a through hole;

a detachable half casing attached to the mounting plate, aligned with the stationary half casing to define the arm slot and having the second toothed ratchet surface and a through hole aligned with the through hole in the stationary half casing; and a fastener mounted and held in the through holes in the detachable half casing and the stationary half casing;

wherein the fastener pivotally holds the inner housing in the arm slot.

2. The adjustable ratchet garment rod as claimed in claim 1, wherein the inner housing comprises two half casings, and each of the half casings has an aligned pivot hole to pivotally hold the fastener and a front recess corresponding to a respective one of the toothed protrusions to receive the corresponding toothed protrusion.

3. The adjustable ratchet garment rod as claimed in claim 2, wherein the suspension arm further has a top edge and multiple annular holes defined completely through the suspension arm along the top edge to hang objects.

4. The adjustable ratchet garment rod as claimed in claim 3, wherein the suspension arm further has a bottom edge and multiple elongated holes defined completely through the suspension arm along the bottom edge to hang objects.

5. The adjustable ratchet garment rod as claimed in claim 1, wherein the inner housing further has a positioning nub extending toward the resilient element holder to define a gap, and the resilient element is inserted and held in the gap between the positioning nub and the resilient element holder.

6. The adjustable ratchet garment rod as claimed in claim 5, wherein the fastener is a bolt.

7. An adjustable ratchet garment rod comprising:

a mounting bracket having an arm slot defined completely through the mounting bracket in a vertical direction and a first toothed ratchet surface and a second toothed ratchet surface formed alongside the arm slot;

an inner housing mounted pivotally in the arm slot and having an arm passage with a front opening and a rear opening, and a resilient element holder formed adjacent to the rear opening in the arm passage;

a resilient element mounted on the resilient element holder and having two free ends bent toward the rear opening of the arm passage; and a suspension arm mounted in the inner housing and having an insert slidably extending into and retractably held in the arm passage through the front opening and two toothed protrusions formed transversely on the insert to engage respectively the toothed ratchet surfaces to hold the suspension arm at a specific angular position, and the insert having an inner end abutting the free ends of the resilient element, wherein the mounting bracket comprises a post sleeve to mount the garment rod on a post; and an outer housing mounted on the post sleeve and comprising a stationary half casing integrally formed on the post sleeve and having a first toothed ratchet surface and a through hole;

a detachable half casing attached to the post sleeve, aligned with the stationary half casing to define the arm slot and having a second toothed ratchet surface and a through hole aligned with the through hole in the stationary half casing; and a fastener mounted and held in the through holes of the detachable half casing and the stationary half casing;

wherein the fastener pivotally holds the inner housing in the arm slot wherein the inner housing comprises two half casings, and each of the half casings has an aligned pivot hole to pivotally hold the fastener and a front recess corresponding to a respective one of the toothed protrusions to receive the corresponding toothed protrusion.

8. The adjustable ratchet garment rod as claimed in claim 7, wherein the suspension arm further has a top edge and multiple annular holes defined completely through the suspension arm along the top edge to bang objects.

9. The adjustable ratchet garment rod as claimed in claim 8, wherein the suspension arm further has a bottom edge and multiple elongated holes defined completely through the suspension arm along the bottom edge to hang objects.

10. The adjustable ratchet garment rod as claimed in claim 9, wherein the inner housing further has a positioning nub extending toward the resilient element holder to define a gap, and the resilient element is inserted and held in the gap between the positioning nub and the resilient element holder.

11. The adjustable ratchet garment rod as claimed in claim 10, wherein the fastener is a bolt.

* * * * *